US007037375B2

(12) United States Patent
Bernert et al.

(10) Patent No.: US 7,037,375 B2
(45) Date of Patent: May 2, 2006

(54) APPLICATION DEVICE

(75) Inventors: Richard Bernert, Giengen (DE); Benjamin Méndez-Gallon, Königsbronn (DE); Manfred Ueberschär, Gerstetten (DE)

(73) Assignee: Voith Paper Patent GmbH, (DE)

( * ) Notice: Subject to any disclaimer, the term of this patent is extended or adjusted under 35 U.S.C. 154(b) by 0 days.

(21) Appl. No.: 10/716,303

(22) Filed: Nov. 18, 2003

(65) Prior Publication Data

US 2004/0107899 A1 Jun. 10, 2004

Related U.S. Application Data

(63) Continuation of application No. PCT/EP02/05621, filed on May 22, 2002.

(30) Foreign Application Priority Data

May 23, 2001 (DE) ..... 101 25 376

(51) Int. Cl.
*B05C 5/00* (2006.01)
*B05C 11/02* (2006.01)

(52) U.S. Cl. ..... 118/325; 118/123; 118/419

(58) Field of Classification Search ..... 118/325, 118/123, 413, 419, 300
See application file for complete search history.

(56) References Cited

U.S. PATENT DOCUMENTS

| | | | | |
|---|---|---|---|---|
| 4,628,856 | A | 12/1986 | Burgdorf | 118/50 |
| 4,821,429 | A | 4/1989 | Sieberth | 34/114 |
| 4,856,205 | A | 8/1989 | Meyer et al. | 34/117 |
| 6,106,902 | A * | 8/2000 | Koskinen et al. | 427/424 |
| 6,309,463 | B1 * | 10/2001 | Hess et al. | 118/302 |
| 6,322,627 | B1 * | 11/2001 | Kusterman | 118/248 |
| 2004/0074440 | A1 * | 4/2004 | Nissinen et al. | 118/300 |

FOREIGN PATENT DOCUMENTS

| | | |
|---|---|---|
| DE | 197 16 647 | 10/1998 |
| DE | 198 03 240 | 7/1999 |
| DE | 199 03 559 | 10/1999 |
| DE | 198 29 449 | 1/2000 |
| DE | 100 12 257 | 9/2001 |

(Continued)

OTHER PUBLICATIONS

Abstract and computer translated documents of JP2000176344A.*

(Continued)

*Primary Examiner*—Chris Fiorilla
*Assistant Examiner*—Yewebdar Tadesse
(74) *Attorney, Agent, or Firm*—Taylor & Aust, P.C.

(57) ABSTRACT

A device for direct or indirect application of liquid or viscous coating medium by way of an application system onto a material web, especially a paper or cardboard web, including a weakening device for weakening the boundary layer of air that is carried along by the application surface. The weakening device is located prior to the applicator device viewed in direction of travel of the application surface. The weakening device includes a blowing device and a suction device. The blowing device is located prior to the applicator device when viewed in direction of travel of the application surface and produces an air flow in opposite direction to the direction of travel. The suction device is located prior to the blowing device when viewed in direction of travel of the application surface and sucks off at least a portion of the air flow that is produced by the blowing device, as well as at least a portion of the boundary layer of air that is carried along by the application surface.

3 Claims, 1 Drawing Sheet

FOREIGN PATENT DOCUMENTS

| | | | |
|---|---|---|---|
| DE | 100 12 347 | | 9/2001 |
| DE | 100 57 734 | | 5/2002 |
| EP | 1 142 647 | | 9/2002 |
| EP | 0 974 403 | | 1/2003 |
| JP | 2000176344 A | * | 6/2000 |
| JP | 2001300386 | | 10/2001 |
| WO | WO 01/16427 | | 3/2001 |

OTHER PUBLICATIONS

Partial Translation of No. 2000-176344, US patent & Trademark Office, Translation Branch, Jul. 20, 2005.*

* cited by examiner

APPLICATION DEVICE

CROSS REFERENCE TO RELATED APPLICATIONS

This is a continuation of PCT application No. PCT/EP02/05621, entitled "APPLICATION DEVICE", filed May 22, 2002.

BACKGROUND OF THE INVENTION

1. Field of the Invention

The present invention relates to a device for the application of liquid or viscous coating medium onto a moving application surface by way of an applicator.

2. Description of the Related Art

When coating a material web by way of a curtain coater (also known in the field as "Curtain Coating") the coating medium is supplied to the application surface in form of a coating medium curtain whose movement from the applicator to the application surface is essentially contingent upon gravity. The fact that the curtain coater is located at a certain distance from the application surface has the added advantage that, for example in the event of a web break, it has a lowered risk of damage exposure. Curtain types of coaters differentiate from other types of "contact-less" applicator devices, for example open jet nozzle type coaters in which the movement of the coating medium from the applicator to the application surface stems primarily from the output impulse from the dispensing nozzle of the applicator, basically because the form of the curtain emerging from the dispensing nozzle is subjected only to the interplay between the surface tension of the coating medium and gravity. In this situation the surface tension attempts to pull together the curtain that, relative to its volume and its cross sectional surface possesses a very large surface or circumferential length, in order to thereby reduce its surface area. This effect is countered only by gravity which attempts to stretch the curtain. It is therefore easily understood that it is more and more difficult with increasing working widths to obtain a coating medium curtain that is uniformly thick across the entire working width.

Coating of material webs by way of curtain coaters that supply the coating medium to the material web in the form of a coating medium curtain or veil whose movement is essentially based upon gravity has been known for some time from coating of photographic films, audio tapes, etc. The material webs associated with this type of application are much narrower than those in a modern line for the production of paper and cardboard webs where web widths of more than 10 m are required. To be able to form and hold stable a uniform coating medium curtain across such widths is a task for which suggestions for functional solutions cannot readily be found in the comparatively easily controlled, known narrow coating medium curtain applications. In addition, material webs in modern lines for the production of paper and cardboard webs run at speeds of up to 3000 m/min. This is many times faster than the speeds with which the known narrow material webs run and represents an additional high demand on the stability of the coating medium curtain.

DE 199 03 559 A1 describes several working principles which are intended to weaken the boundary layer of air that is carried along by the material web, immediately prior to the curtain coater. However, DE 199 03 559 A1 does not address feasibilities of improving the efficiency of these working principles. A multitude of elements are known from WO 01/16427. These are positioned against the material web surface, immediately prior to the curtain coater when viewed in direction of material web travel, in order to prevent the boundary layer of air causing interference with the coating medium curtain. For the sake of completeness with regard to additional state of the art we also refer to DE 197 16 647 A1, DE 199 03 559, DE 198 03 240 A1, DE 198 29 449 A1, EP 0 974 403 A1, as well as the priority older, but later published applications DE 100 12 347 and DE 100 57 734.

The use of a blowing device alone and the use of a suction device alone for facilitating the weakening of the boundary layer of air is basically known from the main application DE 100 12 257. However, in both scenarios strips, brushes or doctor elements are also utilized. They either weaken the boundary layer of air prior to entry into the working range of the suction device, or intend to cause further weakening of the remaining boundary layer of air that is already pre-weakened by the blowing device. These components which are in contact with the material web cause undesirable wear and tear on the material web, as well as on the weakening device. Consequently, this involves the risk of a web break and also increased maintenance costs, as well as increased spare parts expenditure.

SUMMARY OF THE INVENTION

The present invention relates to a device for the application of liquid or viscous coating medium onto a moving application surface by way of an applicator whereby in direct application the application surface is the surface of a material web, specifically a paper or cardboard web, and in indirect application the surface of a transfer element, preferably that of a transfer roll which then transfers the coating medium to the surface of the material web and whereby a device for weakening the boundary layer of air that is carried along by the application surface is provided prior to the applicator, when viewed in direction of travel.

Even though the boundary layer of air that is carried along by the application surface may also negatively influence the coating results produced by other types of applicators, a curtain coater is used in the following example to further discuss the present invention. The curtain coater is an application device whereby the applicator dispenses the coating medium onto the application surface essentially in the form of a gravity dependent moving curtain or veil.

The present invention further advances the applicator device for installation in lines for the production and/or conversion of wide, fast moving material webs, preferably paper or cardboard webs, especially with regard to weakening the influence of the boundary layer of air.

An embodiment of the present invention is a device whereby the weakening device includes a blowing device and a suction device. The blowing device is located prior to the applicator, when viewed in direction of application surface travel and produces an air flow in opposite direction to the direction of travel. The suction device is located prior to the blowing device, when viewed in direction of application surface travel and sucks off at least a part of the air stream that is generated by the blowing device, as well as at least a part of the boundary layer of air that is carried along by the application surface.

Wear and tear on the application surface or material web can be prevented according to the present invention through the combination of a blowing device and a suction device that is installed prior to the blowing device, viewed in direction of web travel. One function of the suction device is to pre-weaken the boundary layer of air that is carried along by the moving application surface. In another function it supports the effect caused by the blowing device in that it sucks off the air stream that was ejected by said blowing device, thereby stabilizing it in its movement along the application surface. The presently inventive weakening device especially does not include any weakening elements that are in contact with the material web, but is instead free of such elements. In this sense the presently inventive weakening device is a weakening device whose operation is completely contact free.

The present invention blowing device can include a blow box that is supplied with air in the area of both lateral edges of the application surface. Based on this two-sided, and preferably symmetric air supply into the blow box, an essentially uniform air stream can be achieved across the working width of the application surface that moves in opposite direction to the boundary layer of air that is carried along by the application surface. The blowing device's delivery nozzle can in this instance include a slotted nozzle or a multitude of individual nozzles.

Correspondingly the present invention suction device can include a suction box whereby air is sucked off only in the area of one of the lateral edges of the application surface, preferably in the area of the drive side edge. This advancement of the present invention takes advantage of the fact that the suction device serves primarily the pre-weakening of the boundary layer of air. Therefore, a structurally complicated and subsequently expensive two-sided suction removal is not necessary.

In order to be able to also improve the stability of the coating medium curtain through the effect of the blowing device it is suggested that, in advancing the present invention the end of the blowing device facing the applicator device, viewed in direction of travel, is positioned at a distance of between approximately 10 mm and approximately 50 mm from the point of contact of the coating medium on the application surface.

If the blowing device includes a baffle that is located at a predetermined distance from the moving application surface, then this baffle in conjunction with the application surface can form a blow channel through which the air that is ejected by the blowing device flows in opposite direction to the direction of travel of the application surface. This improves the efficiency of the effect that the air flow that is ejected by the blowing device has on the boundary layer of air that is carried along by the application surface. This effect is especially effective if the baffle has a length of between approximately 300 mm and 500 mm in the direction of travel of the application surface. If the blowing device is located in the area of a support roll around which the material web travels at least partially, this then corresponds to an angle of wrap of approximately 90°, depending upon the roll diameter.

In a further advancement of the present invention it is suggested that the suction device, viewed in direction of application surface movement, is located at a distance of approximately 0 mm to approximately 50 mm from that end of the baffle or the blowing device that is facing it. Viewed in direction of application surface travel, the blowing device and the suction device can therefore connect directly with each other (distance: 0), or they may be positioned at a predetermined distance from each other so that the suction device must not necessarily be able to suck off the entire air that is ejected by the blowing device.

It is advantageous if a conditioning device is located prior to the weakening device that essentially removes the uppermost layers of the boundary layer of air completely. Normally the efficiency of the weakening device depends upon various influences, for example the running speed of the application surface. Through the removal of the uppermost ranges of the boundary layer of air, the conditioning unit ensures that the dependency upon these influences is reduced, or even totally eliminated. In addition, the weakening device no longer has to advance against the entire boundary layer of air, but only that portion that was permitted passage by the conditioning device. This relieves the weakening device which can therefore be constructed accordingly less efficient.

In a simple embodiment the conditioning device can include a strip, for example a sheet metal strip extending in transverse direction to the application surface. It is however also possible that the conditioning device utilizes aerodynamic effects, for example in that it possesses a cross section, viewed in cross direction, that has the form of an upside-down airfoil profile. Good results can be achieved for example when the conditioning device is positioned at a distance of approximately 3 mm to approximately 10 mm from the application surface. The conditioning device can be self-contained, or it can be mounted to the weakening device.

As already previously mentioned, the present invention weakening device can especially be utilized in an applicator device that includes a curtain coater, which is an applicator device whereby the coating medium is dispensed to the application surface essentially as a gravity dependent curtain or veil.

It is also to be noted that the term "air" in the context of the present description encompasses all gases or gas mixtures which are suitable to influence the boundary layer of air that is carried along by the application surface. For example, instead of air, nitrogen gas can also be used. Air is simply the preferred processing gas, because compressed air is available in almost all plants and is therefore available inexpensively, without additional infra-structural measures.

In the effort to weaken the boundary layer of air, provision can be made additionally or alternatively, that the material web in the area of the weakening device, preferably in the area of or immediately prior to the air outlet of the blowing unit, takes on a curved progression. For example, the material web can be routed around a support roll or/and a support belt or/and a support shoe. As a consequence of the curved progression the boundary layer of air is subject to centrifugal forces that attempt to lift the boundary layer of air from the material web, therefore facilitating the influence of the weakening device, especially of the blowing device upon the boundary layer of air. The curvature radius of the curved progression can be between approximately 300 mm and approximately 500 mm. The smaller the curvature radius is, the larger will be the generated centrifugal force. In practical application however, a lower limit is set for the curvature radius by the deflection characteristics of the material web. Upper limits are set for the curvature radius on the one hand by a reduction in the centrifugal force, and on the other hand by building space considerations.

In order to be able to limit defects in the flow characteristic of the coating medium curtain caused by the web path it is suggested that the material web is fed from below to the point of contact of the coating medium on the application surface. However, if sufficient space is available, it is basically also feasible to feed the web from above.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
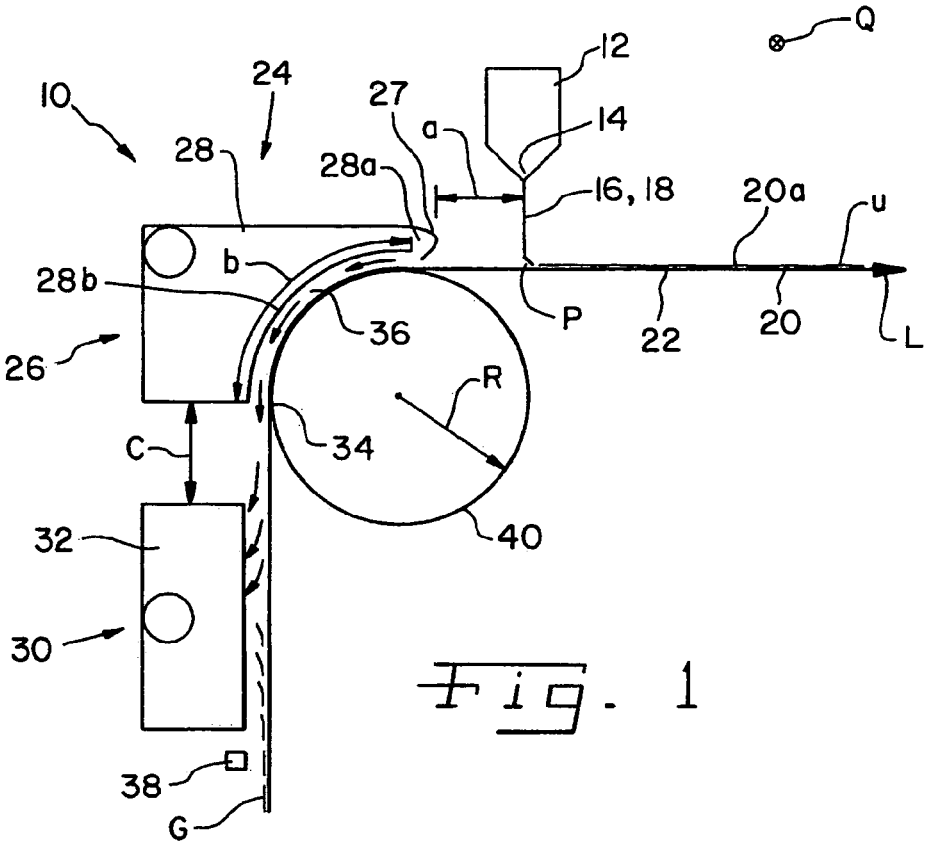
FIG. 1 is a schematic side view of an embodiment of the present invention applicator device.

Referring now to the drawings, and more particularly to FIG. 1, there is shown an inventive applicator device, generally designated 10. Device 10 includes curtain coater 12 from whose dispensing nozzle 14 coating medium 16 is delivered in the form of a coating medium curtain 18 to application surface U that is moving in direction of travel L. The point of contact of coating medium curtain 18 on the application surface U is designated P in FIG. 1. In the illustrated example application surface U is formed by surface 20*a* of material web 20 onto which coating medium 16 is supplied as coating layer 22.

Weakening device 24 is provided prior to applicator device 12, viewed in direction of travel L, in order to weaken the boundary layer of air G that is carried along on the surface of the application surface U. Weakening device 24 includes blowing device 26 with blow box 28 and end 27, and suction device 30 with suction box 32. Viewed in direction of travel L of application surface U, blow box 28 is located immediately upstream from applicator device 12, and especially of coating medium curtain 18. Blow nozzle 28*a* is located from coating medium curtain 18 at a distance a, that is preferably approximately 10 mm to approximately 50 mm. Blow nozzle 28*a* ejects air stream 34 in opposite direction to the direction of travel L that moves in blow channel 36 that is formed by baffle 28*b* and the application surface U, and that weakens the influence of boundary layer of air G upon coating medium curtain 18. This baffle 28*b* has a length b of approximately 300 mm to approximately 500 mm.

Viewed in direction of travel L, suction box 32 is located upstream from blow box 28 at a distance c. Suction box 32 weakens the boundary layer of air G, by sucking it off the application surface U. This is illustrated in FIG. 1 by the lines that are angled relative to the application surface U. However, suction box 32 additionally stabilizes air flow 34 that is ejected from blow box 28, especially to hold it on the surface of application surface U, by also sucking air flow 34 from blow channel 36 and blow box 28. This is indicated in FIG. 1 by the small arrows that are lifted off application surface U. Suction box 32 can accomplish this last mentioned task especially efficiently if it is located immediately prior to blow box 28, in other words, if it is in immediate contact with it (c=0 mm).

In FIG. 1, a conditioning device embodied as square strip 38 is located upstream from suction device 30. Conditioning strip 38 is intended to lift the uppermost layers of the boundary layer of air G, before the areas of the boundary layer of air that are closest to the application surface are brought to suction box 32. As a consequence of this relatively easily provided weakening of the boundary layer of air G, suction device 30 may be less efficient and therefore less expensive. In addition, the strength of boundary layer of air G no longer varies as much in dependency upon the operating parameters of applicator device 10, following conditioning strip 38 as is the case without conditioning strip 38.

Figure 2:
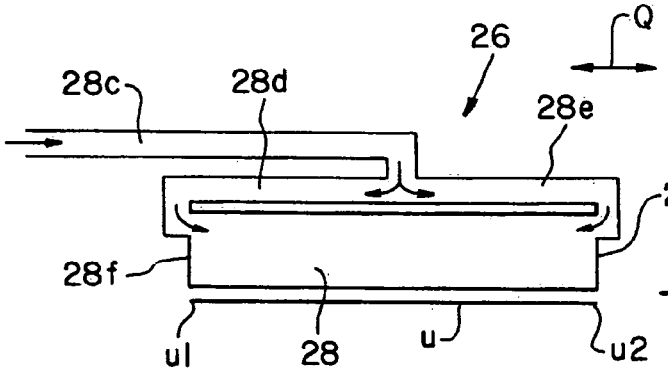
FIG. 2 is schematic view, as seen in direction of travel of the application surface, of an embodiment of a blowing device of the present invention.
Figure 3:
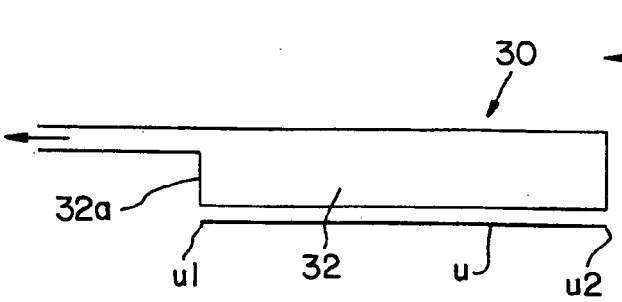
FIG. 3 is a schematic view, seen in direction of travel of the application surface, of an embodiment of a suction device of the present invention.

With reference to FIG. 2, blowing device 26 supplies blow box 28 with air on both sides. In other words, supply line 28*c* splits into two branch lines 28*d* and 28*e* that discharge into drive side face 28*f* or operator side face 28*g* of suction box 28, referred to the cross direction or working width direction Q of application surface U, and associated with lateral edges U1, U2. Based on this two-sided air supply a more uniform air flow 36 can be achieved in cross direction Q. On the other hand, the air is sucked from suction box 32 of suction device 30 only on one face side or edge 32*a*, preferably on the drive side face of suction box 32, as illustrated in FIG. 3.

An additional comment on FIG. 1 is that in the area of blowing device 26 material web 20 is routed around support roll 40 with radius R. Because of the curved web progression boundary layer of air G is subject to a centrifugal force that attempts to lift it from material web 20, therefore facilitating the influence of blowing device 26 upon boundary layer of air G. In addition, material web 20 is brought to support roll 40 from the bottom, to avoid disturbing the flow characteristics of coating medium curtain 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

| Component Identification | |
|---|---|
| 10 | Application device |
| 12 | Curtain Coater |
| 14 | Dispensing nozzle |
| 16 | Coating medium |
| 18 | Coating medium curtain |
| 20 | Material web |
| 20a | Material web surface |
| 22 | Coating layer |
| 24 | Weakening device |
| 26 | Blowing device |
| 27 | End of blowing device |
| 28 | Blow box |
| 28a | Blow nozzle |
| 28b | Baffle |
| 28c | Supply line |
| 28d | Branch line |
| 28e | Branch line |
| 28f | Blow box face - drive side |

-continued

| Component Identification | |
|---|---|
| 28g | Blow box face - operator side |
| 30 | Suction device |
| 32 | Suction box |
| 32a | Suction box face |
| 34 | Air flow |
| 36 | Blow channel |
| 38 | Conditioning device |
| 40 | Support roll |
| a | Distance (blow nozzle to coating medium curtain) |
| b | Length (of baffle) |
| c | Distance (between blow box and suction box) |
| G | Boundary layer of air |
| L | Direction of travel |
| P | Point of contact of coating medium on application surface |
| Q | Cross direction |
| R | Curvature radius |
| U | Application surface |
| U1 | Application surface lateral edge |
| U2 | Application surface lateral edge |

What is claimed is:

1. A device for the direct or indirect application of liquid or viscous coating medium onto a moving application surface, in the direct application the application surface is a surface of a material web, in the indirect application the application surface is a surface of a transfer element, which transfers the coating medium to the surface of the material web, said application surface including a direction of travel, said device comprising:

an applicator; and a weakening device located prior to said applicator as viewed in the direction of travel, said weakening device for weakening a boundary layer of air carried along by the application surface, said weakening device including:

a blowing device located prior to said applicator as viewed in the direction of travel, said blowing device producing an air flow in an opposite direction to the direction of travel; and a suction device being located prior to said blowing device as viewed in the direction of travel, said suction device suctioning both at least a part of said air flow and at least a part of said boundary layer of air; and a conditioning device being located prior to said weakening device as viewed in the direction of travel, said conditioning device essentially removes a plurality of uppermost layers of said boundary layer of air.

2. The device of claim 1, wherein said conditioning device includes a strip that extends in a transverse direction to the application surface.

3. The device of claim 1, wherein said conditioning device is located at a distance of between approximately 3 mm and 10 mm from the application surface.

* * * * *